US008961170B2

(12) United States Patent
Orita et al.

(10) Patent No.: US 8,961,170 B2
(45) Date of Patent: Feb. 24, 2015

(54) DUST COAL BOILER, DUST COAL COMBUSTION METHOD, DUST COAL FUEL THERMAL POWER GENERATION SYSTEM, AND WASTE GAS PURIFICATION SYSTEM FOR DUST COAL BOILER

(75) Inventors: Hisayuki Orita, Hitachinaka (JP); Masayuki Taniguchi, Hitachinaka (JP); Akihito Orii, Hitachi (JP); Yuki Kamikawa, Hitachinaka (JP); Hirofumi Okazaki, Hiroshima (JP)

(73) Assignee: Babcock-Hitachi K.K., Tokyo (JP)

( * ) Notice: Subject to any disclaimer, the term of this patent is extended or adjusted under 35 U.S.C. 154(b) by 1501 days.

(21) Appl. No.: 12/600,221

(22) PCT Filed: May 14, 2008

(86) PCT No.: PCT/JP2008/058809
§ 371 (c)(1),
(2), (4) Date: Nov. 13, 2009

(87) PCT Pub. No.: WO2008/143074
PCT Pub. Date: Nov. 27, 2008

(65) Prior Publication Data

US 2010/0223926 A1 Sep. 9, 2010

(30) Foreign Application Priority Data

May 14, 2007 (JP) ..... 2007-128017

(51) Int. Cl.

| | |
|---|---|
| ***F23D 1/00*** | (2006.01) |
| ***F23C 9/00*** | (2006.01) |
| ***F23J 15/00*** | (2006.01) |
| ***F23L 7/00*** | (2006.01) |

(52) U.S. Cl.
CPC . *F23C 9/003* (2013.01); *F23D 1/00* (2013.01); *F23J 15/006* (2013.01); *F23L 7/002* (2013.01); *F23J 2215/60* (2013.01)
USPC ..... 431/174; 431/151; 431/189; 110/185; 110/191

(58) Field of Classification Search
CPC ..... F23D 14/22; F23D 17/00; F23C 3/008; F23C 9/006; F23C 10/04; F23N 17/00; F23G 2207/103
USPC ..... 431/174, 181, 159, 76, 175, 173, 116; 110/191, 204, 185, 186, 347
See application file for complete search history.

(56) References Cited

U.S. PATENT DOCUMENTS

| | | | | |
|---|---|---|---|---|
| 4,863,489 | A * | 9/1989 | Suggitt | 48/197 R |
| 5,171,552 | A * | 12/1992 | Miura et al. | 423/239.1 |
| 5,848,885 | A * | 12/1998 | Tanaka et al. | 431/215 |
| 6,325,003 | B1 | 12/2001 | Ashworth et al. | |
| 6,338,304 | B2 * | 1/2002 | Yamamoto et al. | 110/261 |
| 6,576,092 | B2 * | 6/2003 | Granite et al. | 204/158.2 |
| 6,938,560 | B2 * | 9/2005 | Okazaki et al. | 110/204 |
| 7,498,008 | B2 * | 3/2009 | Sherman et al. | 423/210 |
| 2003/0206843 | A1 | 11/2003 | Nelson, Jr. | |
| 2004/0003716 | A1 | 1/2004 | Nelson, Jr. | |
| 2004/0200222 | A1 * | 10/2004 | Marin et al. | 60/679 |
| 2005/0103243 | A1 | 5/2005 | Lissianski et al. | |
| 2005/0158223 | A1 | 7/2005 | Lissianski et al. | |
| 2006/0021554 | A1 | 2/2006 | Lissianski et al. | |
| 2006/0115779 | A1 | 6/2006 | Yamamoto et al. | |

FOREIGN PATENT DOCUMENTS

| | | | |
|---|---|---|---|
| CA | 2 522 258 | A1 | 11/2003 |
| CA | 2 577 826 | A1 | 9/2006 |
| EP | 1 533 019 | A1 | 5/2005 |
| EP | 1 854 529 | A1 | 11/2007 |
| JP | 59-24104 | A | 2/1984 |
| JP | 9-21506 | A | 1/1997 |
| JP | 9-196310 | A | 7/1997 |
| JP | 2001-330211 | A | 11/2001 |
| JP | 2005-164228 | A | 6/2005 |
| JP | 2005-524769 | A | 8/2005 |
| JP | 2006-38340 | A | 2/2006 |
| JP | 2006-132811 | A | 5/2006 |

| | | | |
|---|---|---|---|
| JP | 2006-263700 | A | 10/2006 |
| WO | WO 03/092861 | A1 | 11/2003 |
| WO | WO 03/093518 | A1 | 11/2003 |

OTHER PUBLICATIONS

International Search Report with English translation dated Aug. 12, 2008 (Five (5) pages).

* cited by examiner

*Primary Examiner* — Avinash Savani

(74) *Attorney, Agent, or Firm* — Crowell & Moring LLP

(57) ABSTRACT

A pulverized coal thermal power generation system that significantly reduces the amount of NOx emissions from a boiler and does not require a denitration unit is provided. When a denitration unit is not used, performance to remove mercury from a boiler waste gas is reduced. A waste gas purification system for a pulverized coal boiler, that compensates for this is provided.

A pulverized coal boiler having a furnace for burning pulverized coal, burners for supplying pulverized coal and air used for combustion into the furnace so as to burn the pulverized coal in an insufficient air state and after-air ports provided on the downstream side of the burners for supplying air used for perfect combustion characterized in that, an air ratio in the furnace is 1.05 to 1.14, and the residence time of a combustion gas from the burner disposed on the uppermost stage to a main after-air port is 1.1 to 3.3 seconds. Preferably, water is mixed in advance with the air supplied from the after-air port so as to increase the specific heat. Furthermore, pulverized coal carrying air in the burner and a part of air used for combustion are mixed together in advance before they are jetted into the furnace.

A waste gas purification system having a pulverized coal boiler, an air heater disposed downstream of the pulverized coal boiler for exchanging heat with a boiler waste gas to heat air used for combustion in the pulverized coal boiler, a dust removing unit, and a desulfurizing unit characterized in that, at least one of a halogen gas supply unit, a catalyst unit for oxidizing a mercury gas, and a mercury adsorbent blowing device is provided so as to oxidize mercury included in the waste gas.

9 Claims, 9 Drawing Sheets

DUST COAL BOILER, DUST COAL COMBUSTION METHOD, DUST COAL FUEL THERMAL POWER GENERATION SYSTEM, AND WASTE GAS PURIFICATION SYSTEM FOR DUST COAL BOILER

TECHNICAL FIELD

The present invention relates to a pulverized coal boiler, a pulverized coal combustion method by the pulverized coal boiler, and a pulverized coal fuel thermal power generation system. The present invention also relates to a waste gas purification system for the pulverized coal boiler.

BACKGROUND ART

A reduction in the nitrogen oxide (NOx) concentration is demanded for boilers, and various combustion methods are provided to respond to this demand. For example, Patent Document 1 describes a combustion method in which pulverized coal is burnt in three stages: in the first zone, the air ratio is 0.55 to 0.75 and the residence time is 0.1 to 0.3 seconds; in the second zone, the air ratio is 0.80 to 0.99 and the residence time is 0.25 to 0.5 seconds; in the third zone, the air ratio is 1.05 to 1.25 and the residence time is 0.25 to 0.5 seconds.

Patent Document 1: U.S. Pat. No. 6,325,003 (Claims, FIG. 1)

DISCLOSURE OF THE INVENTION

Problems to be Solved by the Invention

However, even when a low-NOx combustion method as described in Patent Document 1 was used, there was a need to install a denitration unit downstream of a boiler to reduce the NOx value at the exit of a chimney to or below an environmental limit value (40 ppm).

An object of the present invention is to provide a pulverized coal combustion method by which the NOx concentration can be further reduced and the NOx concentration at the exit of a chimney satisfies the environmental limit value without a denitration unit, a pulverized coal boiler for achieving the pulverized coal combustion method, and a pulverized coal fuel thermal power generation system.

When a denitration unit is not installed, another object of the present invention is to provide a waste gas purification system for a pulverized coal boiler, by which the performance to remove mercury in a boiler waste gas from the boiler is improved.

Means for Solving the Problems

In a pulverized coal boiler having a furnace for burning pulverized coal, a burner for supplying pulverized coal and air used for combustion into the furnace so as to burn the pulverized coal in an insufficient air state, and an after-air ports provided on the downstream side of the burner for supplying air used for perfect combustion, the present invention is a pulverized coal combustion method for the pulverized coal boiler, characterized in that, an air ratio in the furnace is 1.05 to 1.14, and a residence time of a combustion gas from the burner disposed on the uppermost stage to a main after-air port is 1.1 to 3.3 seconds.

In a pulverized coal boiler having a furnace for burning pulverized coal, a burner for supplying pulverized coal and air used for combustion into the furnace and burning the pulverized coal in an insufficient air state, and an after-air ports provided on the downstream side of the burners for supplying air used for perfect combustion, characterized in that, by satisfying at least one of the conditions described in 1) to 3) below.

1) A ratio of a distance from the burner disposed on an uppermost stage of the furnace to a main after-air port to a height from a bottom of the furnace to a nose is 20% to 30%.

2) A ratio of a distance from the burner disposed on an uppermost stage of the furnace to a main after-air port to a height from the bottom of the furnace to a panel-type heat exchanger with which a combustion gas first makes contact is 20% to 30%.

3) A ratio of a distance from the burner disposed on an uppermost stage of the furnace to a main after-air port to a height of the boiler is 15% to 22%.

The present invention is a pulverized coal fuel thermal power generation system comprising the pulverized coal boiler with the structure described above, a steam turbine for driving a turbine by steam generated from the pulverized coal boiler, an air heater disposed downstream of the pulverized coal boiler for exchanging heat with a boiler waste gas to heat combustion air supplied to burners disposed in the pulverized coal boiler, and a chimney disposed downstream of the air heater for discharging a combustion waste gas.

In a waste gas purification system for a pulverized coal boiler having a pulverized coal boiler for reducing the NOx concentration at the exit of the pulverized coal boiler to or below an environmental limit value for the NOx concentration at the exit of a chimney, the pulverized coal boiler including the pulverized coal boiler with the structure described above, an air heater disposed downstream of the pulverized coal boiler for exchanging heat with a boiler waste gas to heat combustion air for use in the pulverized coal boiler, a dust removing unit disposed downstream of the air heater for removing ash in the boiler waste gas, and a desulfurizing unit disposed downstream of the dust removing unit for removing sulfur oxides in the boiler waste gas, characterized in that, by satisfying at least one of the conditions described in 4) to 6) below.

4) A halogen gas supply unit is provided between the pulverized coal boiler and the air heater, between the air heater and the dust removing unit, or immediately after the dust removing unit.

5) A catalyst unit for oxidizing a mercury gas is provided between the pulverized coal boiler and the air heater, between the air heater and the dust removing unit, or between the dust removing unit and the desulfurizing unit.

6) A mercury adsorbent blowing device and a dust removing unit for removing a mercury adsorbent blown into the boiler waste gas are disposed between the dust removing unit and the desulfurizing unit.

Advantages of the Invention

According to the present invention, the concentration of NOx discharged from a furnace can be greatly reduced and it becomes possible to reduce the concentration to or below the current environmental limit value (40 ppm). Accordingly, a pulverized coal fuel thermal power generation system without a denitration unit and a waste gas purification system for a pulverized coal boiler could be provided.

LEGEND

Figure 1:
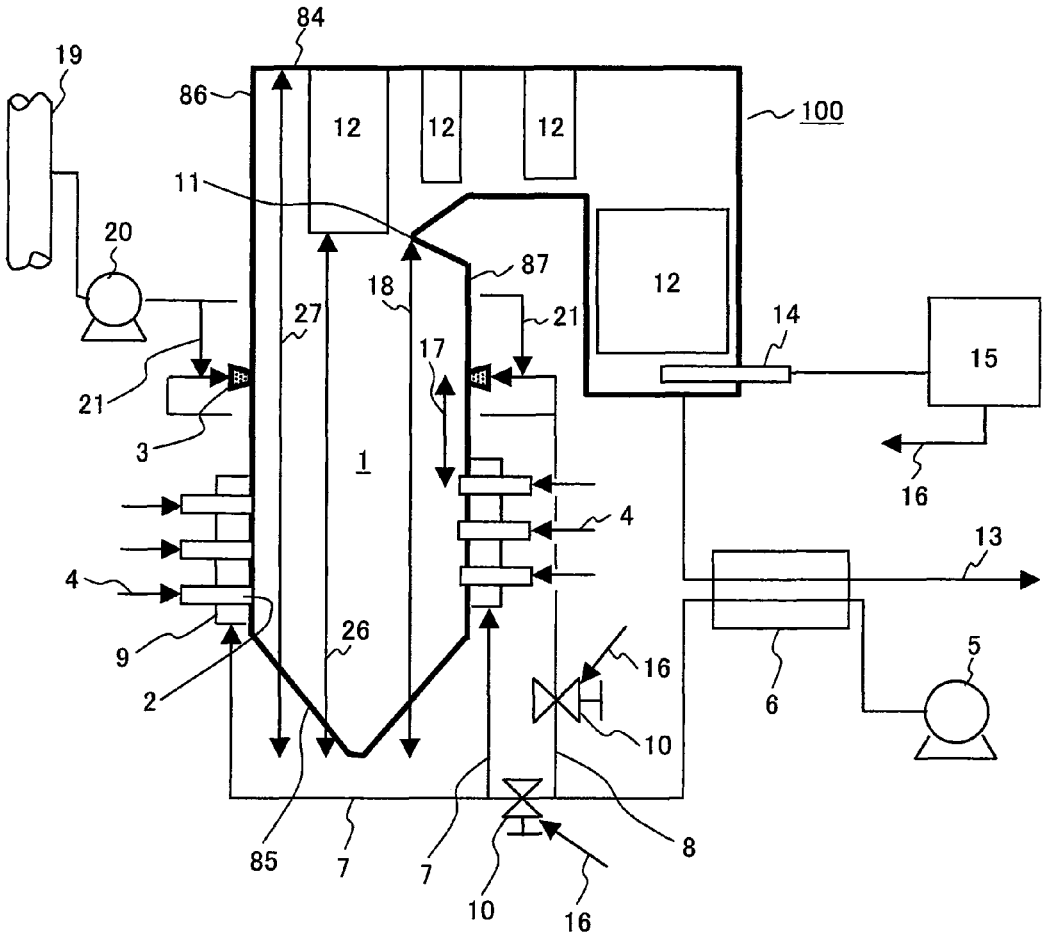
FIG. 1 is a drawing showing the cross section of a furnace part of a pulverized coal boiler according to an embodiment of the present invention as well as paths along which air and pulverized coal are supplied.

1 . . . furnace combustion space, 2 . . . burner, 3 . . . after-air port, 4 . . . primary air and pulverized coal, 5 . . . blower, 6 . . . air heater, 7 . . . burner secondary and tertiary air, 8 . . . after-air, 9 . . . window box, 10 . . . air flow rate controller, 11 . . . nose, 12 . . . panel-type heat exchanger, 13 . . . combustion waste gas, 14 . . . gas sample unit, 15 . . . oxygen densitometer, 16 . . . air flow rate control signal, 17 . . . distance between the burner at the uppermost stage and the after-air port, 18 . . . height from the bottom of the furnace to the nose, 19 . . . industrial water pipe, 20 . . . pump, 21 . . . industrial water, 22 . . . primary air nozzle, 23 . . . secondary air nozzle, 24 . . . tertiary air nozzle, 25 . . . part of secondary and tertiary air, 26 . . . distance from the bottom of the furnace to the panel-type heat exchanger with which a combustion gas first makes contact, 27 . . . boiler height, 40 . . . waste gas suction pump, 71 . . . boiler, 72 . . . denitration unit, 73 . . . air, 74 . . . pulverized coal, 75 . . . dry dust collector, 76 . . . desulfurizing unit, 77 . . . wet dust collector, 78 . . . chimney, 79 . . . activated carbon blowing unit, 80 . . . bag filter, 81 . . . steam, 82 . . . steam turbine, 83 . . . electric generator, 84 . . . furnace ceiling, 85 . . . hopper, 86 . . . furnace front wall, 87 . . . furnace rear wall, 88 . . . partitioning plate, 89 . . . flame holder, 100 . . . furnace, 201 . . . halogen gas supply unit, 202 . . . mercury oxidizing catalyst

BEST MODE FOR CARRYING OUT THE INVENTION

In the case of the pulverized coal combustion method and pulverized coal boiler according to the present invention, it is desirable to increase the specific heat of air supplied from the after-air port by, for example, mixing water into the air in advance. It is also desirable to mix pulverized coal carrying air in the burner and part of the air used for combustion together in advance before they are jetted into the furnace. It is also desirable to mix part of a boiler combustion waste gas into the air supplied from the after-air port. A further reduction in NOx can be thereby achieved.

When the NOx concentration at the exit of the boiler is equal to or below the limit value of the NOx concentration at the exit of a chimney, a denitration unit for reducing NOx in the boiler waste gas is not needed. A denitration unit has the effect of oxidizing the mercury gas in the boiler waste gas. The oxidized mercury has the effect of adhering to combustion ash and for being absorbed in water, and have been thus removed by a dust removing unit for removing ash and furthermore by a desulfurizing unit for removing sulfur oxides. When a denitration unit is not needed, a method for oxidizing the mercury gas is needed in place of the denitration unit. As the method, it is desirable to supply a halogen gas, to install a mercury oxidizing catalyst unit, or to supply a mercury absorbing agent.

The effect of the air ratio in the furnace and the residence time of the combustion gas from the burner on the uppermost stage to the main after-air port on the NOx concentration will be described below. The structures of a pulverized coal boiler and a boiler waste gas purification system that are preferable in achieving the pulverized coal combustion method according to the present invention will also be described.

First Embodiment

FIG. 1 shows the cross section of a furnace part of a pulverized coal boiler according to an embodiment of the present invention and paths along which air and pulverized coal are supplied.

The wall surfaces of the furnace 100 are enclosed by a furnace ceiling 84 at the top, a hopper 85 at the bottom, a furnace front wall 86 on a side, a furnace rear wall 87, and furnace side walls (not shown); water pipes (not shown) are attached to each wall surface. Part of the combustion heat generated in a furnace combustion space 1 is absorbed by these pipes. A combustion gas generated in the furnace combustion space 1 flows from the bottom toward to the top, and heat included in the combustion gas is further collected by panel-type heat exchangers 12. A combustion waste gas 13 from which heat has been collected by the panel-type heat exchangers 12 heats air used for combustion in an air heater 6 and is then discharged from a chimney (not shown).

Burners 2 on a plurality of stages are oppositely disposed at the lower part of the furnace front wall 86 and furnace rear wall 87, in which pulverized coal is burnt in an insufficient air state. A plurality of burners is disposed on each stage. Coal is crushed to about 150 μm or less by a crushing unit (not shown) and transferred by air to the burners 2. Primary air and pulverized coal 4 is jetted from the burners 2 into the furnace. Burner secondary and tertiary air 7 is jetted from the burners 2 through window boxes 9 into the furnace.

An after-air port 3 is disposed above the burners 2. The after-air port may comprise only a main after-air port or may comprise a main after-air port and a sub-after-air port. FIG. 1 shows a boiler in which the after-air port comprises only a main after-air port. The sub-after-air port is often disposed between the main after-air ports or above the main after-air ports. Here, when after-air ports are provided on a plurality of stages in the up-and-down direction of the furnace, a stage with a high flow rate is defined as the main after-air port and a stage with a low flow rate is defined as the sub-after-air port.

Combustion air is supplied from a blower 5, heated by the air heater 6, and then distributed to the burner secondary and tertiary air 7 and to after-air 8.

A gas sample unit 14 is provided on the downstream side of the panel-type heat exchanger 12, which absorbs part of the combustion waste gas 13 and measures the oxygen concentration in the combustion waste gas 13 by using an oxygen densitometer 15. An air flow rate control signal 16 is output from a controller (not shown) so that the measured oxygen concentration matches a value planned in advance. In the present invention, the air flow rate control signal 16 is output so that the oxygen concentration becomes about 2%. This value is equivalent to a furnace air ratio of 1.1. An air flow rate controller 10 is driven according to the air flow rate control signal 16 to adjust the flow rate of either or both of the after-air 8 and the burner secondary and tertiary air 7.

As clarified from the Patent Document 1, a low furnace air ratio is preferable to reduce NOx. However, if the furnace air ratio is too low, the CO concentration becomes high. When the furnace air ratio is lower than 1.05, CO at an equilibrium concentration becomes high, so, in principle, it becomes impossible to reduce CO. Accordingly, the furnace air ratio should be 1.05 or higher. In practice, an operation should be performed at an air ratio slightly higher than 1.05, in view of variations in the air flow rate. In this embodiment, the furnace air ratio was set to 1.1 in view of 5% air flow rate variations.

Industrial water branches from an industrial water pipe 19 provided in the vicinity of the furnace, and industrial water 21 is supplied by a pump 20 to a pipe used by the after-air 8. The industrial water 21 is sprayed into the after-air 8 by using a sprayer (not shown). The temperature of the pulverized coal flame burning in the furnace is then lowered and NOx is further reduced.

To reduce NOx, a distance between the burner at the uppermost stage and the after-air port 17 should be elongated to expand the area in which NOx is deoxidized. The distance 17 between the burner at the uppermost stage and the after-air port should be set so that the residence time of the combustion gas becomes 1.1 to 3.3 seconds. If the residence time is 1.1 seconds or less, NOx is not reduced even when the furnace air ratio is lowered. Accordingly, the NOx concentration becomes high. This phenomenon will be described in detail in FIG. 5. If the residence time is 3.3 seconds or more, combustion at the time of after-air supply becomes difficult. This phenomenon will be described in detail in FIG. 6.

Although the residence time of the combustion gas from the burner on the uppermost stage to the main after-air port is substantially determined by the distance from the burner on the uppermost stage to the main after-air port, the residence time can be more easily controlled by setting furnace design conditions as follows. Specifically, a distance 17 between the burner on the uppermost stage and the main after-air port, that is, the distance from the burner on the uppermost stage to the main after-air port is set so that the ratio of the distance to a height 18 from the bottom of the furnace to a nose 11 is 20% to 30%. Alternatively, the distance from the burner on the uppermost stage to the main after-air port is set so that the ratio of the distance to a height 26 from the bottom of the furnace to the panel-type heat exchanger 12 with which the combustion gas first makes contact is 20% to 30%. Alternatively, the distance from the burner on the uppermost stage to the main after-air port is set so that the ratio of the distance to a boiler height 27 is 15% to 22%.

Figure 2:
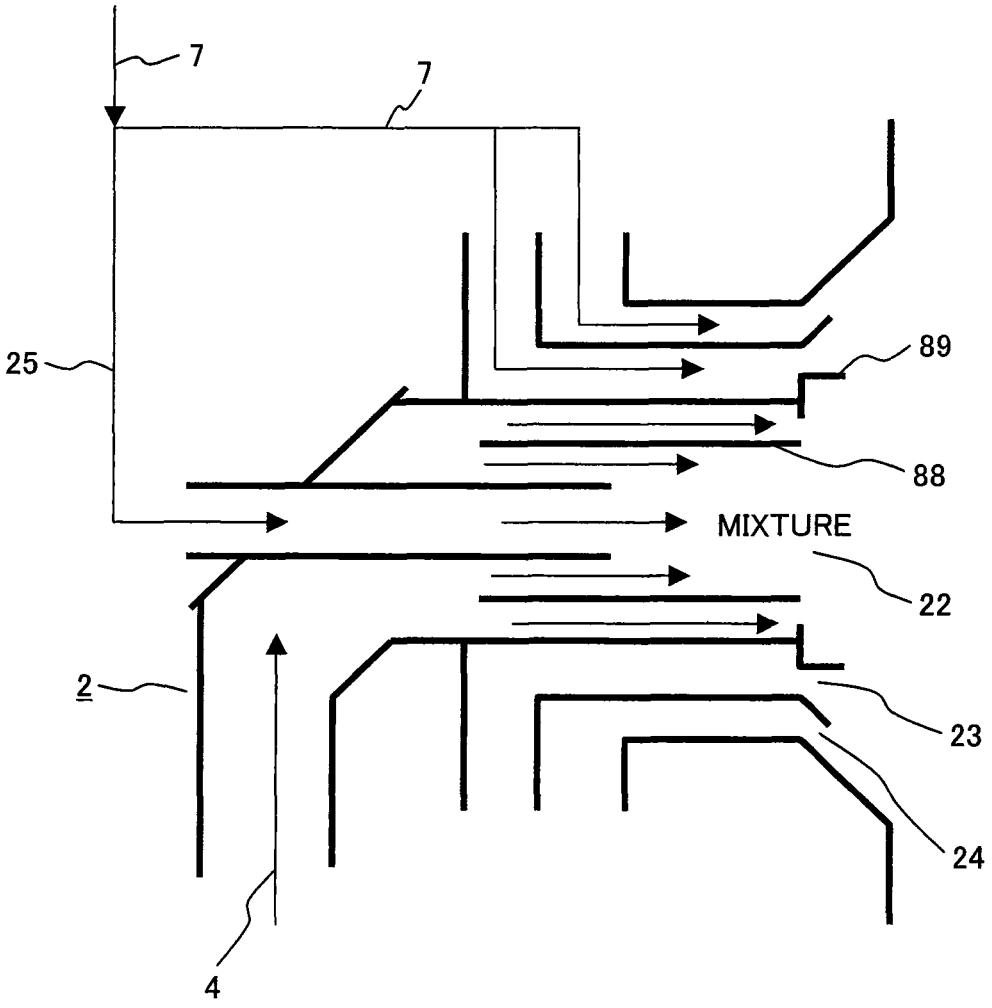
FIG. 2 is a cross sectional view of a burner according to the embodiment of the present invention in a direction in which air flows.

FIG. 2 shows the structure of a burner 2 that is preferable in reducing the NOx concentration.

The combustion air is jetted from a primary air nozzle 22, a secondary air nozzle 23, and a tertiary air nozzle 24. Primary air and pulverized coal 4 is jetted from the center of the burner. Part of the secondary and tertiary air 25 branches from the burner secondary and tertiary air 7 and is then included into a flow of the primary air and pulverized coal 4 from the center of the burner. The pulverized coal concentration is thereby reduced and the NOx concentration is reduced. Part of the primary air and pulverized coal 4 is made to branch by a partitioning plate 88 and flows on the outer circumference side of the partition plate 88. An arrangement is made so that the primary air and pulverized coal 4 flowing on the outer circumference side of the partition plate 88 is not mixed with a part of secondary and tertiary air 25 at that time. For example, the end of the partition plate 88 is disposed more forward than the exit from which the part of secondary and tertiary air 25 is jetted. With this arrangement, the pulverized coal concentration is not reduced in the vicinity of a flame holder 89 and ignitibility is maintained.

Second Embodiment

Figure 3:
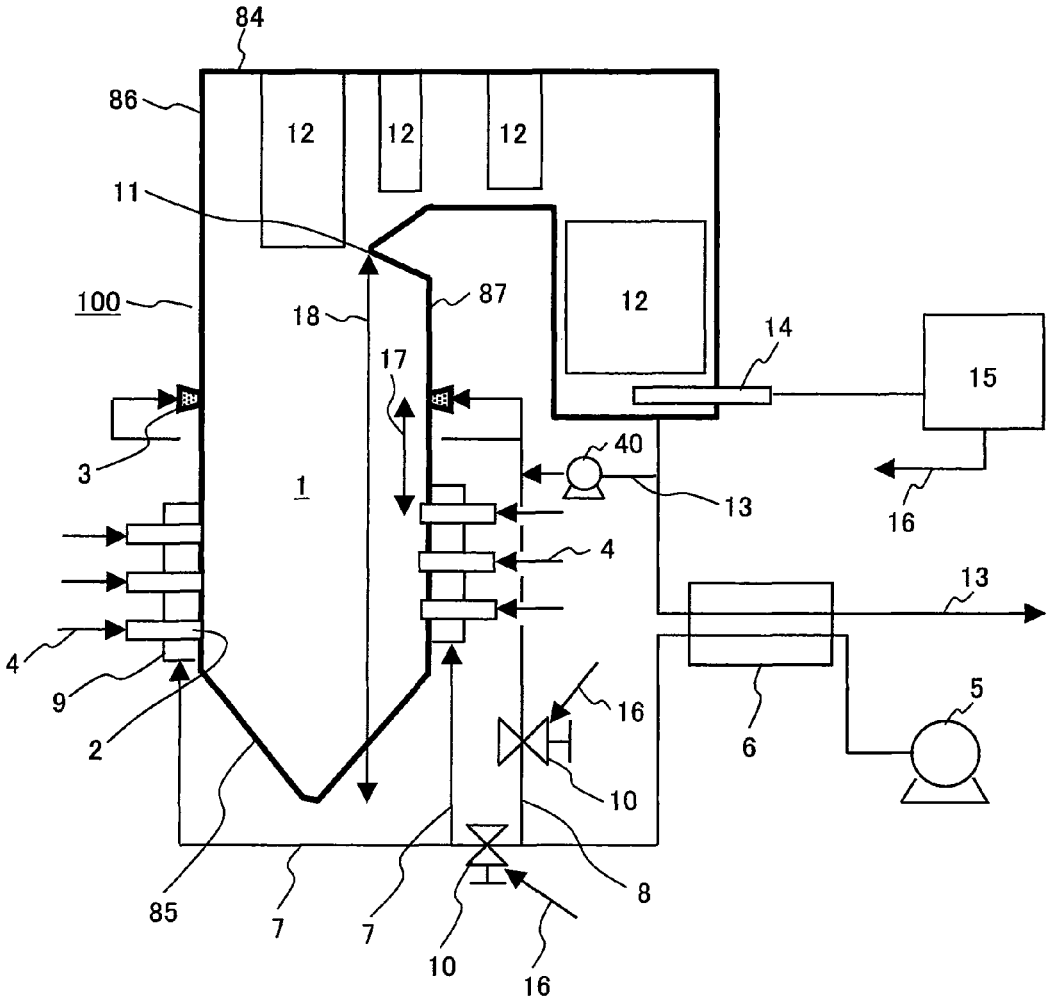
FIG. 3 is a drawing showing the cross section of a furnace part of a pulverized coal boiler according to another embodiment of the present invention as well as paths along which air and pulverized coal are supplied.

FIG. 3 shows a pulverized coal boiler according to another embodiment of the present invention, illustrating the cross section of a furnace part.

Here, part of the combustion waste gas 13 is sucked and supplied from the after-air ports 3 to the furnace. The combustion waste gas 13 is sucked by a waste gas suction pump 40 and included into the after-air 8. The after-air 8 including the combustion waste gas 13 is released from the after-air ports 3 into the furnace. Since the combustion waste gas 13 is included into the after-air 8, the specific heat of the gas is increased. In addition, the oxygen concentration in the gas is lowered. Accordingly, the combustion temperature is lowered and the amount by which NOx is generated is lessened. In addition, since the waste gas is included, the velocity of the flow of the gas jetted from each after-air port is increased, facilitating mixing in the furnace. Then, CO is also reduced The effect of the present invention will be verified.

Figure 4:
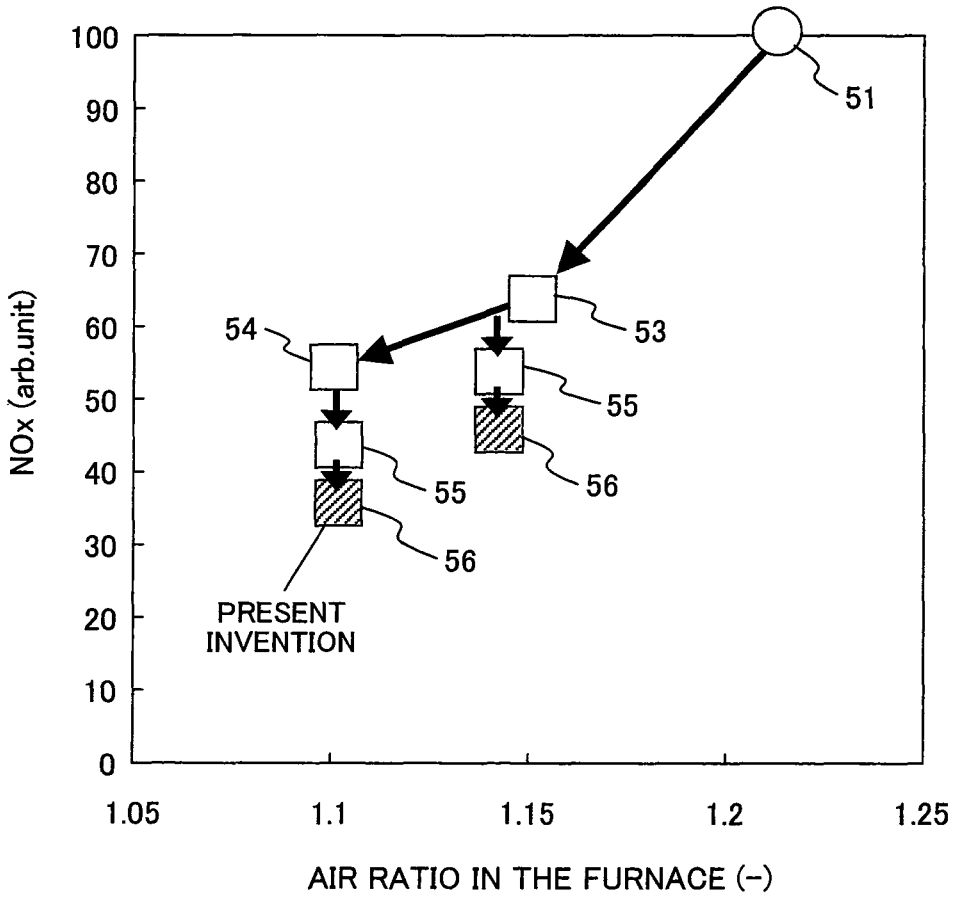
FIG. 4 is a drawing illustrating a result obtained by verifying an NOx reduction effect in the present invention through calculation.

FIG. 4 illustrates a result obtained by verifying the NOx reduction effect by the present invention through calculation.

The symbol 51 indicates NOx performance when a conventional technology was used to cause combustion at a furnace air ratio of 1.2. The symbol 53 indicates NOx when the residence time from the burner on the uppermost stage to the after-air port was prolonged and the furnace air ratio was set to 1.15, generating a reduction of about 30%. The symbol 54 indicates NOx when the furnace air ratio was further reduced to 1.10, generating about a 50% reduction in NOx.

The symbol 55 indicates NOx when the residence time from the burner on the uppermost stage to the after-air port was prolonged, the furnace air ratio was set to 1.14 and 1.1, the burner was remodeled to a burner having the structure shown in FIG. 2, and pulverized coal carrying air in the burner and part of combustion air were mixed together before they were jetted into the furnace. The symbol 56 indicates NOx when a burner having the structure shown in FIG. 2 was used and water was included in the after-air. Under the conditions for the symbol 56, NOx was further reduced.

It was found from these results that the NOx concentration can be reduced below the limit value at the exit of a chimney by applying technologies (1) to (3) below and setting the furnace air ratio to 1.14 or less, and thereby the use of a denitration unit can be eliminated and costs can be reduced.

(1) The residence time from the burner on the uppermost stage to the after-air port is prolonged.

(2) Pulverized coal carrying air in the burner and part of combustion air are mixed together before they were jetted into the furnace.

(3) Water is included in the after-air.

Figure 5A:
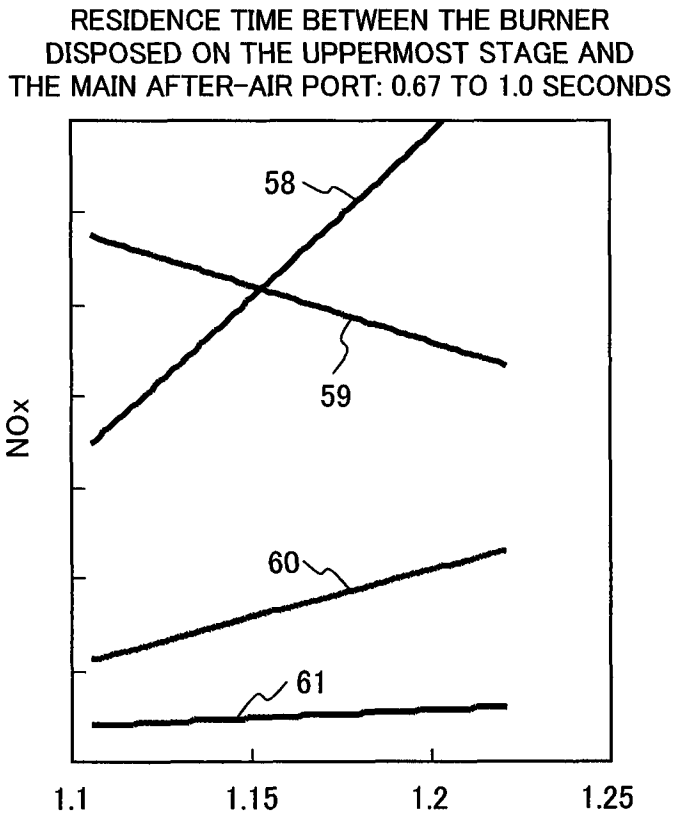
FIG. 5 is a drawing illustrating measurement results of the relations between a furnace air ratio and NOx for different residence times of a combustion gas from the burner on the uppermost stage to a main after-air port.
Figure 5B:
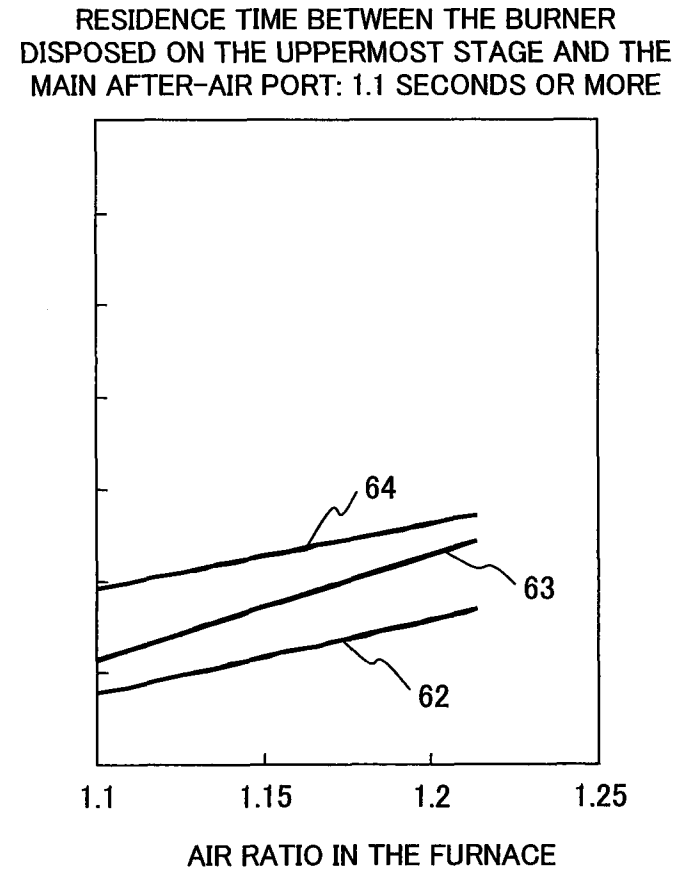

FIG. 5 illustrates results obtained by experimentally investigating the relations between the furnace air ratio and NOx with different residence times of the combustion gas from the burner on the uppermost stage to the after-air port. FIG. 5(*b*) illustrates a result obtained by experimentally investigating the relations between the furnace air ratio and NOx with different coal properties under the condition that the residence time of the combustion gas from the burner on the uppermost stage to the after-air port is 1.1 seconds or more. Although the residence times indicated by the reference numerals 62, 63, and 64 were all 1.15 seconds, different types of coal were used. In all cases, when the furnace air ratio was lowered, NOx decreased monotonously. It was found from this result that NOx can be more reduced at a furnace air ratio of 1.14 or less than at a furnace air ratio of 1.2 under the condition that residence time of the combustion gas from the burner on the uppermost stage to the after-air port is 1.1 seconds or more.

FIG. 5(*a*) illustrates results obtained by investigating the relations between the furnace air ratio and NOx with different coal properties under the condition that the residence time of the combustion gas from the burner on the uppermost stage to the after-air port is from 0.67 seconds to 1.0 second. The residence time indicated by the reference numeral 61 was 0.7 seconds, and the residence times indicated by the reference numerals 58, 59, and 60 were 0.95 seconds. Under this condition, NOx could not be necessarily reduced by reducing the furnace air ratio. In the case of reference numerals 58 and 60, NOx was reduced by lowering the furnace air ratio. Conversely, in the case of reference numeral 59, NOx was increased when the furnace air ratio was lowered. In the case of reference numeral 61, NOx was almost unchanged even when the furnace air ratio was changed. As described above, when the residence time from the burner on the uppermost stage to the after-air port was short, low NOx performance could not be obtained in a stable manner even when the furnace air ratio was lowered.

It was found from these results that to perform low NOx combustion with a low furnace air ratio, the residence time of the combustion gas from the burner on the uppermost stage to the after-air port must be set to 1.1 seconds or more.

Figure 6:
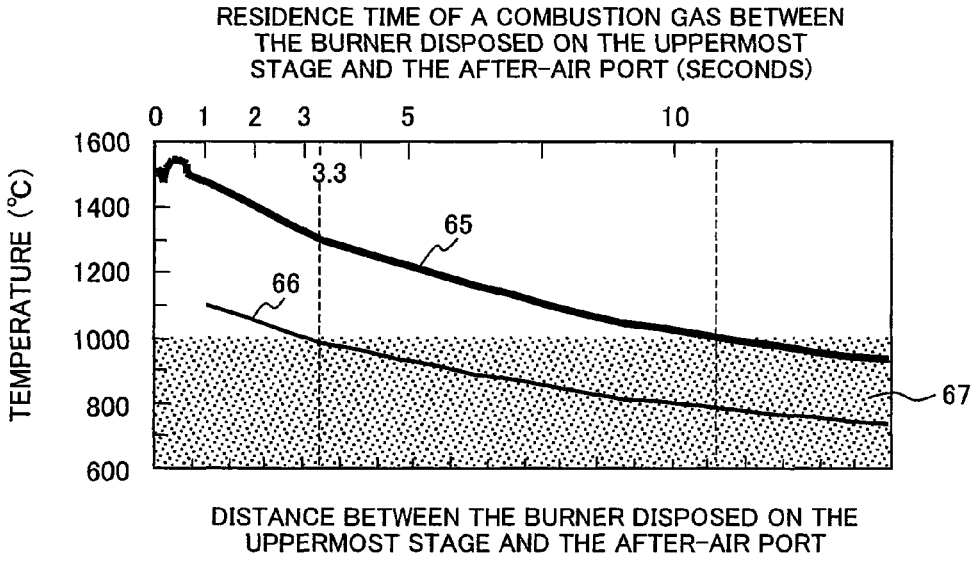
FIG. 6 is a drawing illustrating a calculation result of the relation between the residence time of a combustion gas from the burner on the uppermost stage to the main after-air port and the combustion gas temperature at an after-air inlet.

FIG. 6 illustrates results of the relation between the residence time of the combustion gas from the burner on the uppermost stage to the after-air port and the gas temperature at the inlet of the after-air part. Curve 65 indicates a gas temperature when the combustion gas reached the inlet of the after-air part, and curve 66 indicates a temperature when the combustion gas that reached the inlet of the after-air part and the after-air were mixed together. Range 67 indicates a temperature condition under which the gas became hard to ignite. The conditions required to have the boiler combustion system function correctly are that the temperature when the gas at the inlet of the after-air part and the after-air are mixed together is higher than the temperature in a range 67 and satisfies the ignition temperature condition.

When the residence time of the combustion gas from the burner on the uppermost stage to the after-air port is prolonged, the temperature of the gas at the inlet of the after-air part is gradually lowered. This is preferable when thermal NOx has to be reduced. If the temperature when the gas at the inlet of the after-air part and the after-air are mixed together falls to or below 1000° C., however, ignition becomes hard and the system does not function correctly.

Accordingly, there is an upper limit for preferable values of the residence time of the combustion gas from the burner on the uppermost stage to the after-air port.

According to the calculation results in FIG. 6, the upper limit of the residence time between the burner on the uppermost stage and the after-air port is about 3.3 seconds.

Third Embodiment

Figure 7:
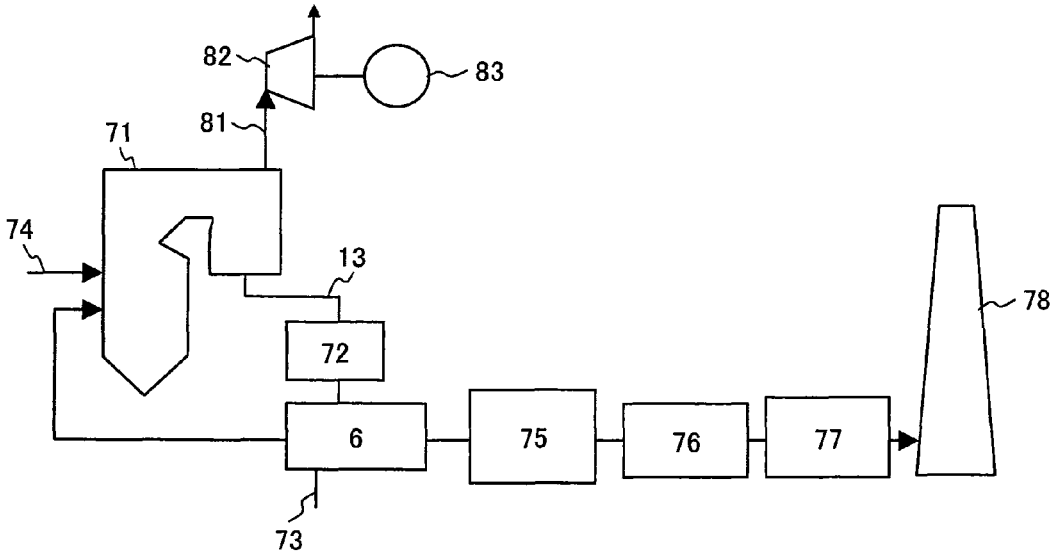
FIG. 7 is a layout of units in a conventional general pulverized coal fuel thermal power generation system.

FIGS. 8 to 13 show the layout of units in a waste gas purification system for the pulverized coal boiler according to the present invention. FIG. 7 shows the layout of units in a conventional general gas purification system for a pulverized coal boiler as a comparative example.

In the power generation system in the comparative example, pulverized coal 74 is supplied to a boiler 71 to carry out combustion. Steam 81 generated by combustion heat from the pulverized coal is led to a steam turbine 82 so that the steam turbine 82 and an electric generator 83 connected to the turbine are driven. A combustion waste gas 13 after the combustion is first led to a denitration unit 72. In the denitration unit 72, ammonia is supplied to deoxidize NOx so that the NOx concentration becomes no higher than 40 ppm that is a converted value based on 6% $O_2$. The combustion waste gas 13 then performs heat exchange in the air heater 6 to heat air 73 used for combustion. Next, a dry dust collector 75 removes dust and a desulfurizing unit 76 removes SOx. After mist generated in the desulfurizing unit 76 is removed by a wet dust collector 77, a combustion waste gas 13 is discharged from a chimney 78.

Figure 8:
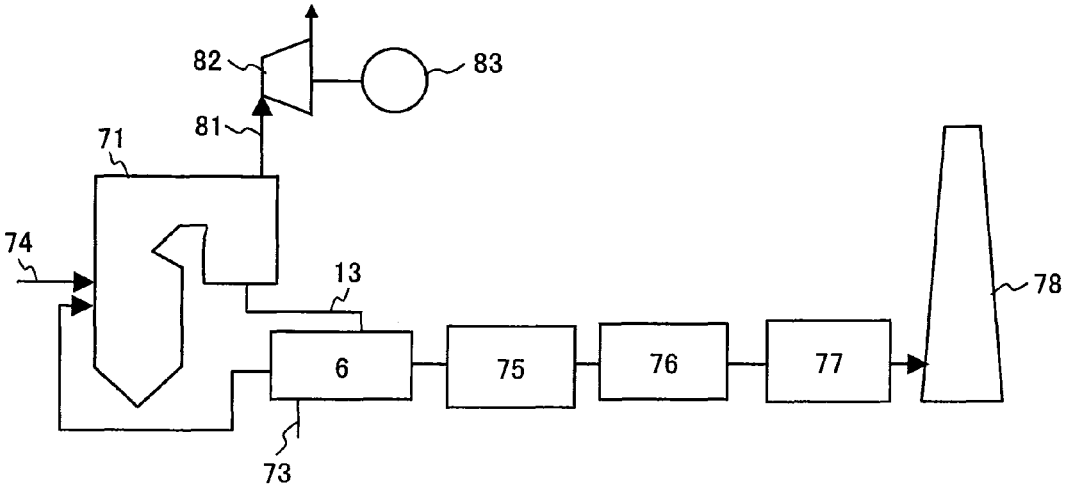
FIG. 8 shows a pulverized coal fuel thermal power generation system to which a pulverized coal combustion method according to the present invention is applied.

FIG. 8 shows an embodiment of a power generation system that uses the boiler according to the present invention. If PRB coal is used as the fuel, NOx generated from the boiler 71 can be lowered to or below 40 ppm, so the use of a denitration unit can be eliminated. The combustion waste gas 13 directly enters the air heater 6. The dry dust collector 75, desulfurizing unit 76, wet dust collector 77, and chimney 78 are disposed downstream of the air heater 6, as in the prior art.

A catalyst is inserted in the denitration unit; NOx in the boiler waste gas is deoxidized to $N_2$ by supplying an ammonia ($NH_3$) gas. The catalyst reacts with the mercury (Hg) gas in the boiler waste gas and a halogen gas (a hydrogen chloride (HCl) gas, for example) and oxidizes the Hg gas, generating a mercury chloride ($HgCl_2$) gas. The mercury chloride ($HgCl_2$) gas is absorbed into ash in the boiler waste gas, and is thereby removed together with the ash by the dry dust collector 75, which is a back wash dust collector. The $HgCl_2$ gas is also absorbed into water, and is thereby removed by a back wash desulfurizing unit that uses lime slurry.

Here, if no denitration unit is required, the action for oxidizing the Hg gas is reduced. A method of facilitating oxidization of the Hg gas is then needed. The method is to increase the concentration of the halogen gas that reacts with the Hg gas and to provide a specific catalyst that oxidizes the Hg gas. The method is to further reduce the Hg gas in the boiler waste gas by supplying an adsorbent that adsorbs the Hg gas.

Figure 9:
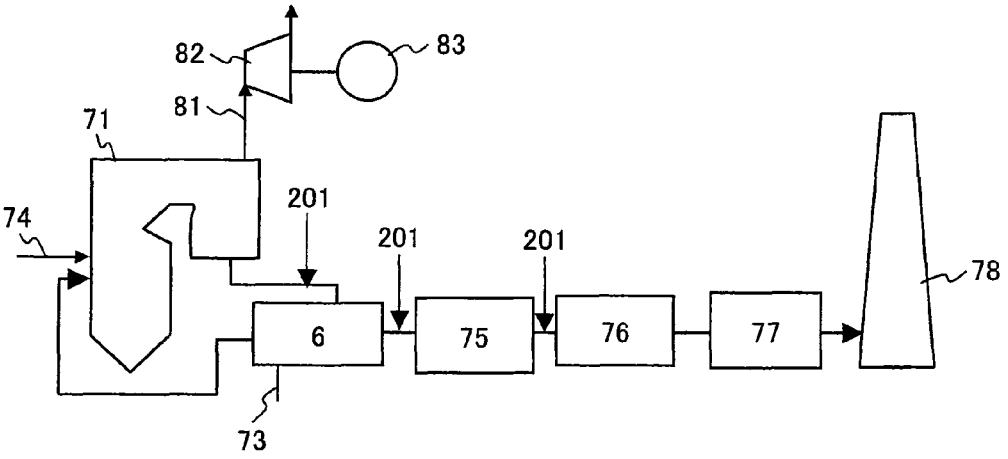
FIG. 9 is a layout of units in a pulverized coal fuel thermal power generation system, having a halogen gas supply unit, according to an embodiment of the present invention.

FIG. 9 shows the layout of units in a waste gas purification system having a halogen gas supply unit for the pulverized coal boiler according to the present invention. The halogen gas supply unit is disposed immediately before the air heater 6, between the air heater 6 and the dry dust collector 75, or between the dry dust collector 75 and the desulfurizing unit 76.

An HCl gas will be taken as an example of the halogen gas. When the HCl gas is supplied, it produces a chlorine ($Cl_2$) gas in an equilibrium reaction, and the generated $Cl_2$ gas further reacts with the Hg gas, generating an $HgCl_2$ gas. In the equilibrium reaction of the HCl gas and $Cl_2$ gas, the amount of the HCl gas increases as the temperature rises, and the amount of the $Cl_2$ gas increases as the temperature drops. The rate of the reaction between the $Cl_2$ gas and the Hg gas increases as the temperature rises. When the temperature is too high, the $Cl_2$ gas is lessened, suppressing the generation of $HgCl_2$. When the temperature is too low, the reaction rate of the $Cl_2$ gas and Hg gas is lowered, suppressing the generation of $HgCl_2$. Accordingly, there is an optimum temperature range in $HgCl_2$ generation, and the preferable temperature range is from 150° C. to 400° C.

The temperature of the waste gas discharged from the boiler changes as follows: the waste gas enters the air heater 6 at about 400° C., where it performs heat exchange, and lowers to about 150° C. in the dry dust collector 75. Accordingly, a point from which to supply the halogen gas is in a range from immediately before the air heater 6 to immediately before the dry dust collector 75.

Figure 10:
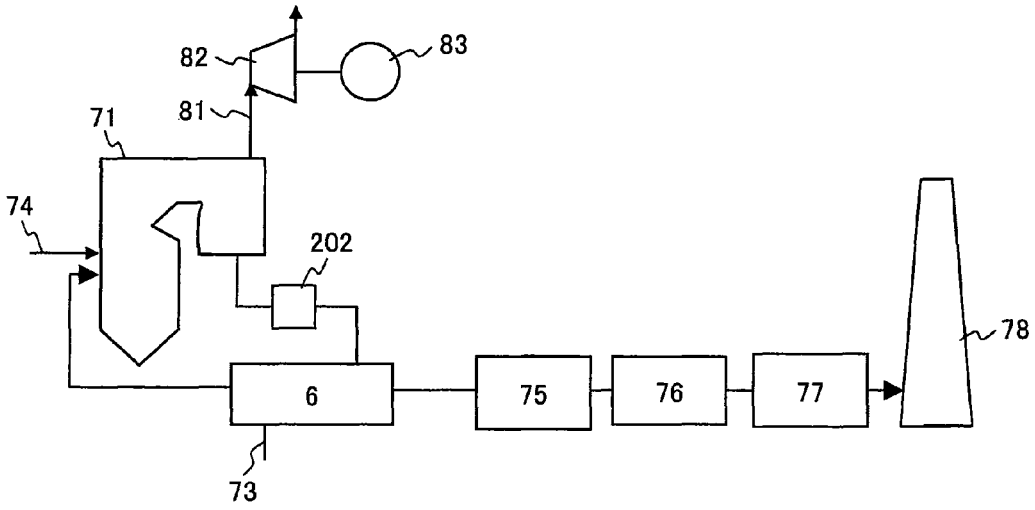
FIG. 10 is a layout of units in a pulverized coal fuel thermal power generation system, having a mercury oxidizing catalyst unit, according to the present invention.
Figure 11:
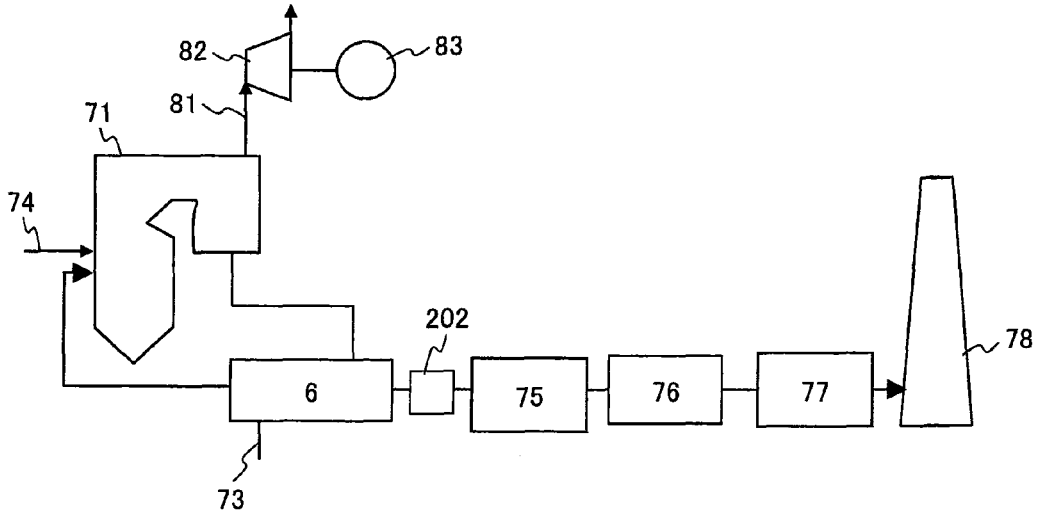
FIG. 11 is a layout of units in a pulverized coal fuel thermal power generation system, having a mercury oxidizing catalyst unit, according to another embodiment of the present invention.
Figure 12:
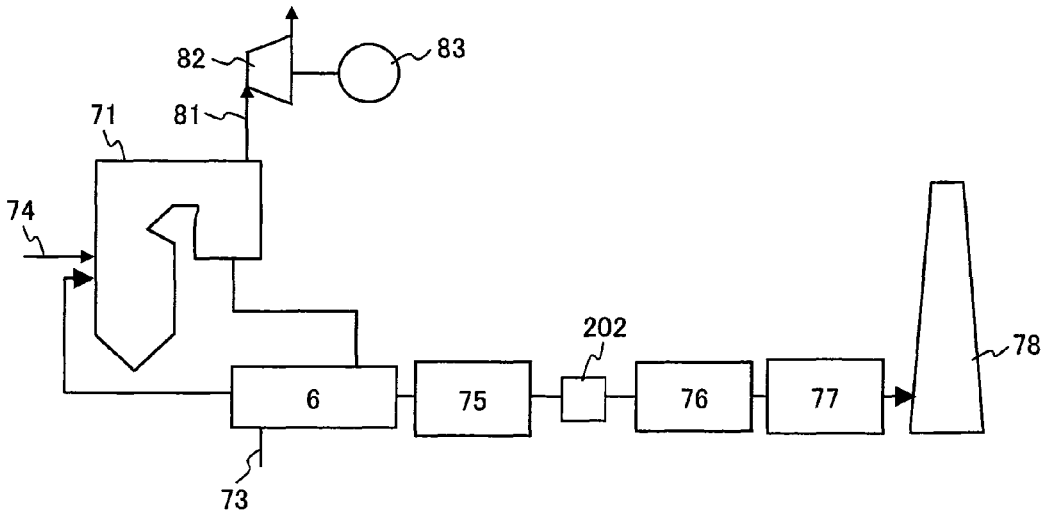
FIG. 12 is a layout of units in a pulverized coal fuel thermal power generation system, having a mercury oxidizing catalyst unit, according to another embodiment of the present invention.

FIGS. 10 to 13 show the layouts of units in waste gas purification systems having a mercury oxidizing catalyst unit for the pulverized coal boiler according to the present invention. In FIG. 10, a mercury oxidizing catalyst unit 202 is disposed immediately before the air heater 6; in FIG. 11, the mercury oxidizing catalyst unit 202 is disposed between the air heater 6 and the dry dust collector 75; in FIG. 12, the mercury oxidizing catalyst unit 202 is disposed between the dry dust collector 75 and the desulfurizing unit 76.

When an HCl gas is taken as an example, the mercury oxidizing catalyst enhances the action to generate a $Cl_2$ gas from the HCl gas. The usage temperature range varies with the components constituting the catalyst; the range is from 150° C. to 400° C.

If PRB coal is used as the coal, the amount of Cl included in the coal is small. This type of coal should be used together with a mercury oxidizing catalyst unit to supply a halogen gas. In this case, the halogen gas is supplied upstream of the mercury oxidizing catalyst unit.

Figure 13:
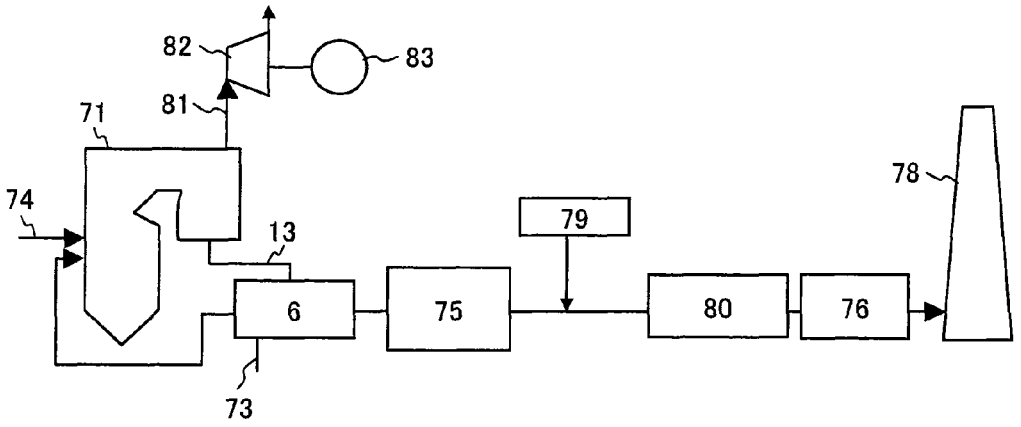
FIG. 13 is a layout of units in a pulverized coal fuel thermal power generation system, having a mercury oxidizing catalyst unit, according to another embodiment of the present invention.

FIG. 13 shows the layout of units in a waste gas purification system that supplies a mercury adsorbent for the pulverized coal boiler according to the present invention. To adsorb the Hg gas and $HgCl_2$ gas that are included in the waste gas, an activated carbon blowing unit 79 is provided downstream of the dry dust collector 75. Activated charcoal is a mercury adsorbent. The activated charcoal into which mercury has been adsorbed is collected by a bag filter 80.

Ash collected by the dry dust collector 75 is effectively used, for example, in cement. If the activated charcoal is included, the ash cannot be effectively used. Accordingly, the activated charcoal is blown into the back wash of the dry dust collector 75.

Although each of the boilers 71 in FIGS. 10 to 13 is the boiler according to the present invention, another boiler may be used if the NOx concentration at the exit of the boiler 1 is not higher than the NOx concentration limit value at the exit of the chimney 78.

According to the present invention, a pulverized coal fuel thermal power generation system that reduces NOx and eliminates the use of a denitration unit can be provided and costs of a power generation system can be reduced, as described above. In addition, even when a denitration unit is eliminated, a boiler waste gas purification system that ensures mercury removing performance can be provided.

INDUSTRIAL APPLICABILITY

The present invention can be applied to a pulverized coal boiler and to a thermal power generation system that uses the pulverized coal boiler.

The invention claimed is:

1. A waste gas purification system for a pulverized coal boiler comprising:

a pulverized coal boiler, an air heater disposed downstream of the pulverized coal boiler for exchanging heat with a boiler waste gas to heat combustion air for use in the pulverized coal boiler, a dust removing unit disposed downstream of the air heater for removing ash in the boiler waste gas, a desulfurizing unit disposed downstream of the dust removing unit for removing sulfur oxides in the boiler waste gas, a catalyst unit for oxidizing a mercury gas provided between the pulverized coal boiler and the air heater or between the dust removing unit and the desulfurizing unit, and a halogen gas supply unit further provided downstream of the pulverized coal boiler and upstream of the catalyst unit, wherein the pulverized coal boiler comprises a furnace for burning pulverized coal, a burner for supplying pulverized coal and air used for combustion into the furnace so as to burn the pulverized coal in an insufficient air state, and an after-air port provided on a downstream side of the burner for supplying air used for perfect combustion, and wherein a ratio of a distance from the burner disposed on an uppermost stage of the furnace to a main after-air port to a height from a bottom of the furnace to a nose is 20% to 30%.

2. A waste gas purification system for a pulverized coal boiler comprising:

a pulverized coal boiler, an air heater disposed downstream of the pulverized coal boiler for exchanging heat with a boiler waste gas to heat combustion air for use in the pulverized coal boiler, a dust removing unit disposed downstream of the air heater for removing ash in the boiler waste gas, a desulfurizing unit disposed downstream of the dust removing unit for removing sulfur oxides in the boiler waste gas, a catalyst unit for oxidizing a mercury gas provided between the pulverized coal boiler and the air heater or between the dust removing unit and the desulfurizing unit, and a halogen gas supply unit further provided downstream of the pulverized coal boiler and upstream of the catalyst unit, wherein the pulverized coal boiler comprises a furnace for burning pulverized coal, a burner for supplying pulverized coal and air used for combustion into the furnace so as to burn the pulverized coal in an insufficient air state, an after-air port provided on a downstream side of the burner for supplying air used for perfect combustion, and a panel-type heat exchanger for collecting combustion gas heat, and wherein a ratio of a distance from the burner disposed on an uppermost stage of the furnace to a main after-air port to a height from a bottom of the furnace to the panel-type heat exchanger with which a combustion gas first makes contact is 20% to 30%.

3. A waste gas purification system for a pulverized coal boiler comprising:

a pulverized coal boiler, an air heater disposed downstream of the pulverized coal boiler for exchanging heat with a boiler waste gas to heat combustion air for use in the pulverized coal boiler, a dust removing unit disposed downstream of the air heater for removing ash in the boiler waste gas, a desulfurizing unit disposed downstream of the dust removing unit for removing sulfur oxides in the boiler waste gas, a catalyst unit for oxidizing a mercury gas provided between the pulverized coal boiler and the air heater or between the dust removing unit and the desulfurizing unit, and a halogen gas supply unit further provided downstream of the pulverized coal boiler and upstream of the catalyst unit, wherein the pulverized coal boiler comprises a furnace for burning pulverized coal, a burner for supplying pulverized coal and air used for combustion into the furnace so as to burn the pulverized coal in an insufficient air state, and an after-air port provided on a downstream side of the burner for supplying air used for perfect combustion, and wherein a ratio of a distance from the burner disposed on an uppermost stage of the furnace to a main after-air port to a height of the boiler is 15% to 22%.

4. The waste gas purification system for a pulverized coal boiler according to claim 2, wherein a ratio of a distance from the burner disposed on an uppermost stage of the furnace to a main after-air port to a height from a bottom of the furnace to a nose is 20% to 30%.

5. The waste gas purification system for a pulverized coal boiler according to claim 1, wherein a water mixing means is provided for mixing water into the air supplied from the after-air port in advance.

6. The waste gas purification system for a pulverized coal boiler according to claim 1, wherein a mixing means is provided for mixing pulverized coal carrying air and a part of air used for combustion together in the burner in advance before the pulverized coal carrying air and the part of air are jetted into the furnace.

7. The waste gas purification system for a pulverized coal boiler according to claim 1, wherein a combustion waste gas mixing means is provided for mixing part of a combustion waste gas from the pulverized coal boiler into the air supplied from the after-air port.

8. A pulverized coal fuel thermal power generation system comprising the pulverized coal boiler according to claim 1, the pulverized coal fuel thermal power generation system comprising a steam turbine for driving a turbine by steam generated from the pulverized coal boiler, an air heater disposed downstream of the pulverized coal boiler for exchanging heat with a boiler waste gas to heat combustion air supplied to a burner disposed in the pulverized coal boiler, and a chimney disposed downstream of the air heater for discharging a combustion waste gas.

9. A waste gas purification system for a pulverized coal boiler comprising:

a pulverized coal boiler, an air heater disposed downstream of the pulverized coal boiler for exchanging heat with a boiler waste gas to heat combustion air for use in the pulverized coal boiler, a dust removing unit disposed downstream of the air heater for removing ash in the boiler waste gas, a desulfurizing unit disposed downstream of the dust removing unit for removing sulfur oxides in the boiler waste gas, a catalyst unit for oxidizing a mercury gas is provided between the pulverized coal boiler and the air heater or between the dust removing unit and the desulfurizing unit, a halogen gas supply unit further provided downstream of the pulverized coal boiler and upstream of the catalyst unit, a mercury adsorbent blowing device for blowing a mercury adsorbent into the boiler waste gas, and a dust removing unit for removing the mercury adsorbent from the boiler waste gas into which the mercury adsorbent is blown disposed between the dust removing unit and the desulfurizing unit.

* * * * *